US010124474B2

(12) United States Patent
Mayer et al.

(10) Patent No.: US 10,124,474 B2
(45) Date of Patent: Nov. 13, 2018

(54) IMPACT SCREWDRIVER

(71) Applicant: C. & E. Fein GmbH, Schwaebisch Gmuend-Bargau (DE)

(72) Inventors: Bernd Mayer, Ellwangen (DE); Anatoli Pankraz, Schwaebisch Gmuend (DE); Adrian Vogt, Oechsen (DE); Norbert Woecht, Boebingen an der Rems (DE)

(73) Assignee: C. & E. Fein GmbH, Schwaebisch Gmuend-Bargau (DE)

( * ) Notice: Subject to any disclaimer, the term of this patent is extended or adjusted under 35 U.S.C. 154(b) by 381 days.

(21) Appl. No.: 14/932,578

(22) Filed: Nov. 4, 2015

(65) Prior Publication Data

US 2016/0121470 A1 May 5, 2016

(30) Foreign Application Priority Data

Nov. 4, 2014 (DE) ..... 10 2014 116 032

(51) Int. Cl.
*B25B 23/147* (2006.01)
*B25B 21/02* (2006.01)

(52) U.S. Cl.
CPC ..... *B25B 23/1475* (2013.01); *B25B 21/026* (2013.01)

(58) Field of Classification Search
CPC ..... B25B 23/02; B25B 23/026; B25B 23/14; B25B 23/147; B25B 23/1475
USPC ..... 173/2
See application file for complete search history.

(56) References Cited

U.S. PATENT DOCUMENTS 3,578,091 A * 5/1971 States ..... B25B 23/1453 173/176
4,056,762 A 11/1977 Schadlich
6,598,684 B2 * 7/2003 Watanabe ..... B25B 21/02 173/176
6,607,041 B2 * 8/2003 Suzuki ..... B25B 21/02 173/11
6,687,567 B2 * 2/2004 Watanabe ..... B25B 23/1405 173/11

(Continued)

FOREIGN PATENT DOCUMENTS

DE 2516951 A1 10/1976
DE 2835382 A1 2/1980

(Continued)

*Primary Examiner* — Jason Daniel Prone
*Assistant Examiner* — Richard Crosby, Jr.
(74) *Attorney, Agent, or Firm* — Muncy, Geissler, Olds & Lowe, P.C.

(57) ABSTRACT

An impact screwdriver having a housing includes an impact mechanism including a hammer interacting with an anvil for driving a tool, wherein the hammer is arranged on a drive shaft so as to be axially movable and preloaded in the axial direction, and wherein the hammer is driven by the drive shaft via a driver and is preloaded counter to the force of a spring element in order to trip and to transmit a rotary impulse to the anvil when a particular rotation angle is exceed, wherein the hammer and the anvil are mounted in a manner electrically insulated from one another and are connected to a voltage source, and wherein a sensor is provided for monitoring a current flow between the hammer and anvil during contact thereof for determining a contact duration between the hammer and anvil.

21 Claims, 3 Drawing Sheets

(56) References Cited

U.S. PATENT DOCUMENTS

| | | | | |
|---|---|---|---|---|
| 8,109,344 | B1 * | 2/2012 | Hays | B25F 3/00 173/171 |
| 8,844,939 | B2 * | 9/2014 | Woecht | B25F 3/00 279/140 |
| 2014/0182869 | A1 | 7/2014 | Kumagai et al. | |
| 2016/0121470 | A1 * | 5/2016 | Mayer | B25B 23/1475 173/181 |

FOREIGN PATENT DOCUMENTS

| | | | |
|---|---|---|---|
| DE | 3128558 | A1 | 3/1983 |
| DE | 102013021202 | A1 | 7/2014 |

* cited by examiner

IMPACT SCREWDRIVER

CROSSREFERENCES TO RELATED APPLICATIONS

This application claims priority from German patent application 102014116032.0, filed on Nov. 4, 2014. The entire content of this priority application is incorporated herein by reference.

BACKGROUND OF THE INVENTION

The invention relates to an impact screwdriver having a housing in which an impact mechanism having a hammer is accommodated, said hammer interacting with an anvil to drive a tool, wherein the hammer is accommodated on a drive shaft so as to be axially movable and preloaded in the axial direction, and wherein the hammer is driven by the drive shaft via a driver and is preloaded counter to the force of a spring element in order to trip when a particular rotation angle is exceeded and transmit a rotary impulse to the anvil.

An impact screwdriver of this type is known from DE 10 2013 021 202 A1. The known screwdriver is configured to tighten screw connections but does not have a measuring device in order to be able to set a predetermined tightening torque.

DE 31 28 558 A1 discloses a further impact screwdriver, in which the duration of the impact impulses is continually measured and compared with a predetermined minimum impulse duration associated with the desired final torque, and the impact screwdriver is switched off when an impact impulse duration corresponding to the minimum impulse duration is reached. In this case, the impulse duration is measured via a magnetic switch and compared with the minimum impulse duration.

Monitoring of the impact impulse duration by means of a magnetic switch is relatively complicated, both in terms of production and in terms of assembly. Alternatively, the switch is also said to be able to be embodied as an electric or electronic switch, but no disclosure is given as to how such a switch is configured.

SUMMARY OF THE INVENTION

In view of this it is an object of the invention to disclose an impact screwdriver which allows for a monitoring of the tightening torque of a screw connection in an easy and cost-effective manner.

A second object of the invention is to disclose an impact screwdriver that has a simple and reliable design.

A third object of the invention is to disclose an impact screwdriver that offers a high durability.

A still further object of the invention is to disclose an impact screwdriver that allows for a monitoring of the tightening torque of a screw connection in manner that ensures a high consistency.

These and other objects are solved by an impact screwdriver comprising:

- a housing;
- an impact mechanism received within said housing, wherein said impact mechanism comprises:
- an output shaft coupled to a tool receptacle;
- an anvil coupled to said output shaft;
- a drive shaft for driving said impact mechanism;
- a hammer arranged on said drive shaft axially movable;
- a spring element arranged for preloading said hammer in an axial direction towards said anvil;

- a driver for driving said hammer towards said anvil;
- wherein said hammer is driven by said drive shaft via said driver and is preloaded counter to the force of said spring element for tripping against said anvil and for transmitting a rotary impulse onto said anvil, when a particular angle of rotation is exceeded;
- wherein said hammer and said anvil are mounted electrically insulated against one another and are connected to a voltage source; and
- wherein a sensor is arranged for monitoring a current flow between said hammer and said anvil during contact between said hammer and said anvil for determining a duration of said contact.

The object of the invention is achieved in this way.

Since the hammer and anvil are arranged in a manner electrically insulated from one another, when a voltage source is connected, monitoring of the contact duration resulting from a contact between hammer and anvil can be ensured in a very easy and reliable manner.

In a preferred configuration of the invention, provision is made of a controller which is configured to measure the rotational speed of the drive shaft and which is configured to calculate a tightening torque of a screw connection to be tightened from the rotational speed of the drive shaft and an integrated contact duration between the hammer and anvil.

In this way, the tightening torque of a screw connection to be tightened can be determined with high precision in a very easy and reliable manner.

According to a further configuration of the invention, the housing has a first housing part in which the impact mechanism is accommodated with the drive shaft, the hammer and a bearing, which is electrically insulated from a second housing part in which the anvil is accommodated with a drive spindle.

In this way, electrical contact between the hammer and anvil is very easy to ensure.

According to a further configuration of the invention, the first and the second housing part are connected to the voltage source, wherein the sensor for monitoring a current flow between the two housing parts is connected by a contact between the hammer and anvil.

This results in easy and reliable monitoring of the contact duration between the hammer and anvil.

In a preferred configuration of the invention, the controller is configured to switch off the impact mechanism when a predetermined tightening torque is reached.

In this way, a predetermined tightening torque for a screw connection can be maintained in a relatively precise manner.

According to a further configuration of the invention, the controller is programmed such that a measured integral of contact durations between the hammer and anvil is compared with a stored dependence of the torque on the impulse duration and is taken into consideration in the calculation of the tightening torque.

This allows a predetermined tightening torque to be maintained in a very precise manner.

In a further configuration of the invention, the drive has a planetary gear which is coupled to the drive shaft to drive the latter.

To this end, the planetary gear set can have for instance a planet gear carrier on which planet gears are rotatably mounted, wherein the planet gear carrier is coupled to the drive shaft so as to rotate therewith.

Moreover, the planet gear carrier can in this case be mounted on the housing in a rotatable manner. Driving can take place via a sun gear which is driven by a motor shaft and which meshes with the planet gears.

It goes without saying that the abovementioned embodiments and those yet to be explained in the following text are usable not only in the combination given in each case but also in other combinations or on their own, without departing from the scope of the present invention.

BRIEF DESCRIPTION OF THE DRAWINGS

Further features and advantages can be gathered from the following description of a preferred exemplary embodiment with reference to the drawing, in which.

DESCRIPTION OF PREFERRED EMBODIMENTS

Figure 1:
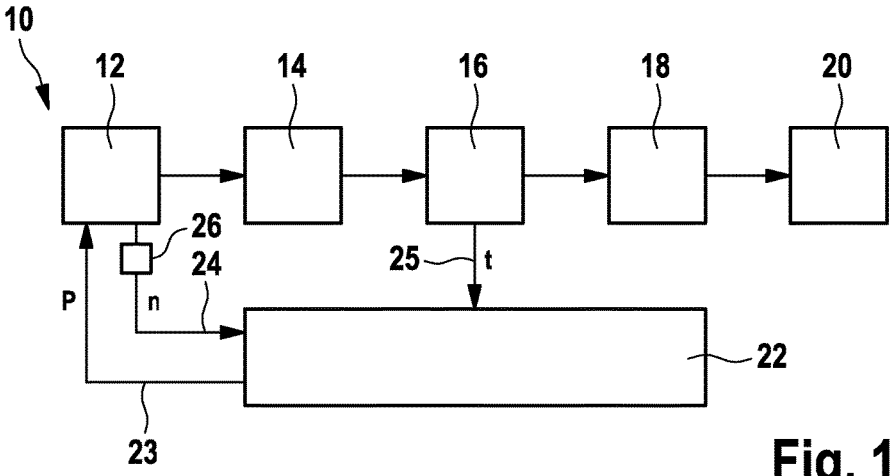
FIG. 1 shows a simplified block diagram illustrating the control of an impact screwdriver according to the invention.

FIG. 1 shows a simplified circuit diagram of an impact screwdriver according to the invention, which is designated as a whole by the numeral 10.

The impact screwdriver has a drive 12, for instance in the form of an electric motor which is coupled to a gear mechanism. The drive 12 drives a movably arranged hammer 14 which interacts with an anvil 18 in order to transmit a sequence of rotary impulses to the latter. Via an electric coupling 16 between the hammer 14 and anvil 18 the respective contact duration t between the hammer 14 and anvil 18 is determined and transmitted via a line 25 to a central controller 22. The anvil 18 is coupled to an output shaft 20 on which a tool such as a bit or a nut for tightening a screw connection is accommodated.

The central controller 22, which is preferably embodied as a microprocessor controller, controls the output P of the drive 12 via a line 23. Via an associated line 24, the rotational speed n of the drive 12 is sensed by the central controller 22 by means of a sensor 26.

For the measurement, an electrical contact duration between the hammer 14 and anvil 18, as indicated at 16, is determined and evaluated by the central controller 22.

Figure 2A:
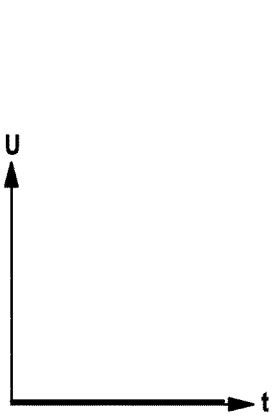
FIG. 2*a* shows a voltage signal, picked up by a sensor, which is zero as long as there is no contact.
Figure 2:
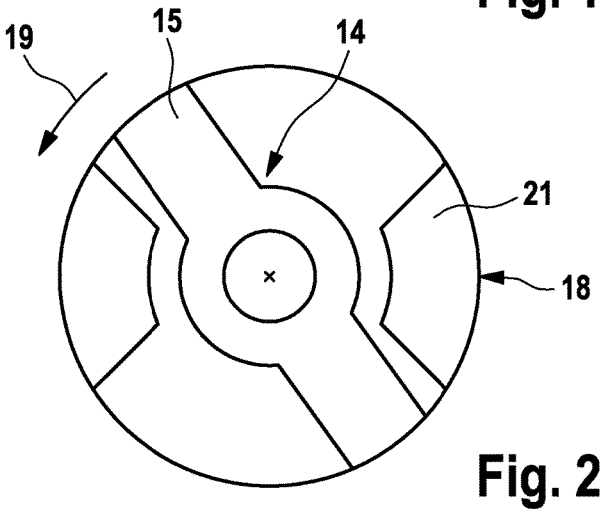
FIG. 2 shows a schematic front view of the hammer and anvil in a position in which there is no contact between the hammer and anvil.
Figure 3A:
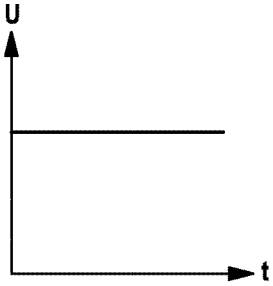
FIG. 3*a* shows an associated voltage signal from the sensor.

FIG. 2 schematically illustrates how the hammer 14 is located in a position away from the anvil 18 such that there is no electrical contact, as is indicated schematically in FIG. 2*a*. By way of a rotary impulse on the hammer 14 in the direction of the arrow 19 as per FIG. 2, the hammer 14 moves from the position illustrated in FIG. 2 into a position shown in FIG. 3, which is indicated by 14'. In this case, the hammer 14 transmits its rotational energy via its two drivers 15 in part to associated protrusions 21 on the anvil 18. As a result of the direct contact between the hammer and anvil, a voltage signal, which is schematically illustrated in FIG. 3*a*, occurs during the contact.

The structure of the impact screwdriver 10 will now be explained in more detail with reference to FIG. 4.

Figure 4:
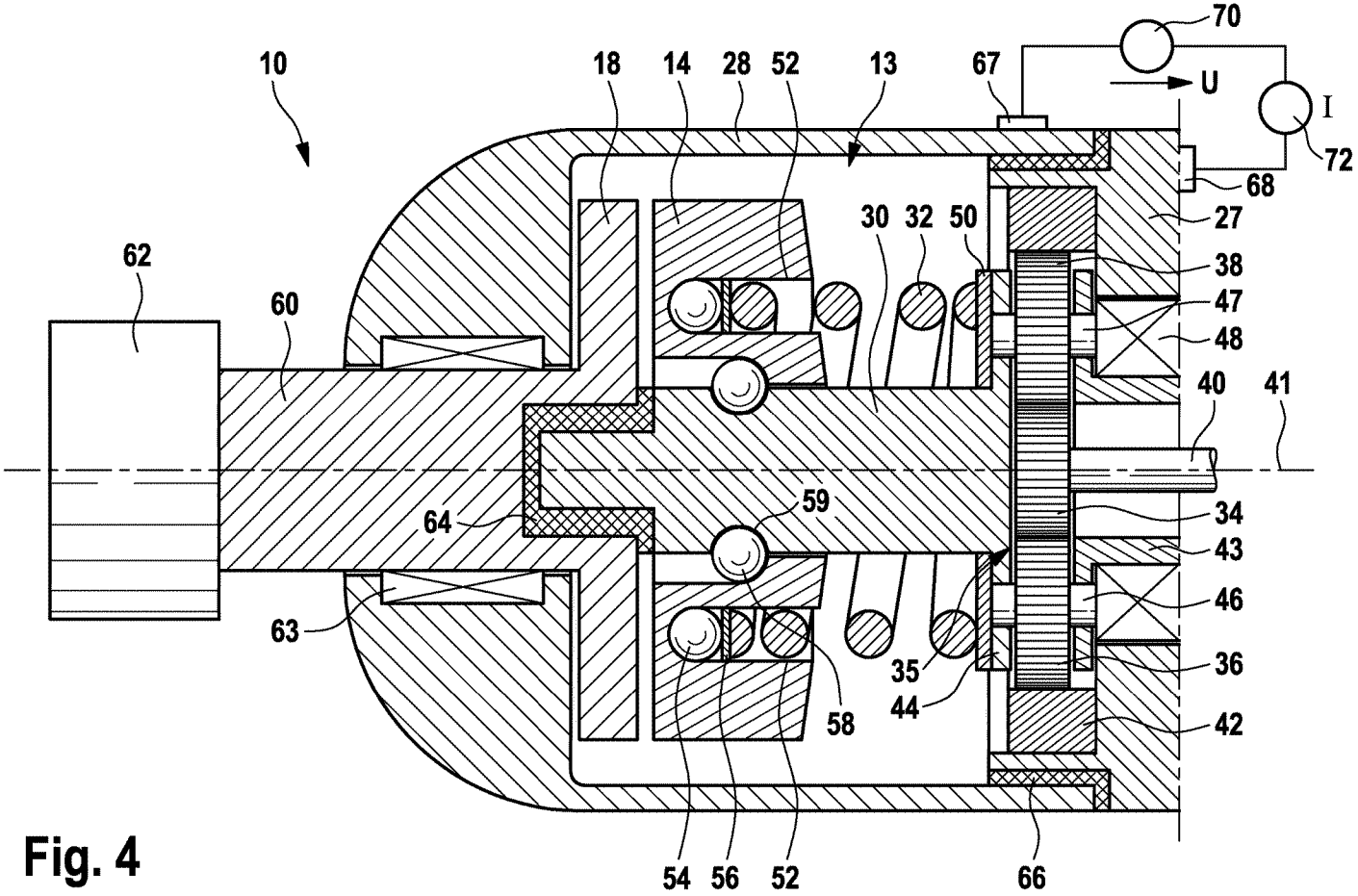
FIG. 4 shows an enlarged partial longitudinal section through an impact screwdriver according to the invention, from which the interaction of the hammer and anvil and the drive via a planetary gear set are visible, wherein a monitoring device for monitoring the electrical contact between the hammer and anvil is indicated.

The impact screwdriver 10 has a first housing part 27, which is illustrated only in part in FIG. 4 and in which a motor (only motor shaft 40 indicated) in addition to an associated gear mechanism 35 and an impact mechanism 13 are held. The first housing part 27 is connected via an electrically isolating connection 66 to a second housing part 28 into which the impact mechanism 13 projects and in which an anvil 18, which is provided at the end of an output shaft 60, is accommodated by means of a bearing 63. Provided at the outer end of the output shaft 60 is a tool receptacle 62 in which a screwdriving tool, for instance a bit or a nut, can be inserted in order to tighten a screw connection.

The gear mechanism 35 is configured as a planetary gear and has a planet gear carrier 43 which is mounted in a rotatable manner on the first housing part 27 by means of a bearing 48. On the planet gear carrier 43, a total of three planet wheels 36, 38, of which only two are discernible in FIG. 4, are mounted in a rotatable manner on shaft stubs 46, 47 which are connected to an associated flange extension 44 of a drive shaft 30. The drive shaft 30 is mounted via an electrically isolating plain bearing 64 in a recess in the anvil 18 and is mounted on the gear-mechanism side on the first housing part 27 via the planet wheel carrier 43 by means of the bearing 48.

The planetary gear 35 is driven via the motor shaft 40, at the end of which provision is made of a sun gear 34 which meshes with the planet gears 36, 38. Externally, the planet gears 36, 38 engage in a stationary ring gear 42 which is accommodated on the second housing part 27. If the motor shaft 40 is driven, the sun gear 34 drives the planet gears 36, 38 and causes the planet gear carrier 43 to rotate about a longitudinal axis 41 of the motor shaft 40 and the drive shaft 30, respectively.

On the drive shaft 30, the hammer 14 is arranged in an axially displaceable manner and is preloaded in the direction of the anvil 18 by means of a coil spring 32 which is supported on the flange extension 44 via a ring 50. The coil spring 32 engages with its end in an annular recess 52 in the hammer 14 and is supported via a disc 56 on balls 54 which bear against the end of the annular recess 52.

The hammer 14 is mounted in an axially displaceable manner by means of two balls 58 which protrude partially outwards from the surface of the drive shaft 30. The balls 58 interact with a curved track 59 which extends in a spiral shape along the outer surface of the drive shaft. In principle, one ball 58, which interacts with a curved track 59, would suffice. In the exemplary embodiment illustrated, however, provision is made of two curved tracks 59 which are offset through 180° with respect to one another and interact in this case with in each case one ball 58.

Figure 3:
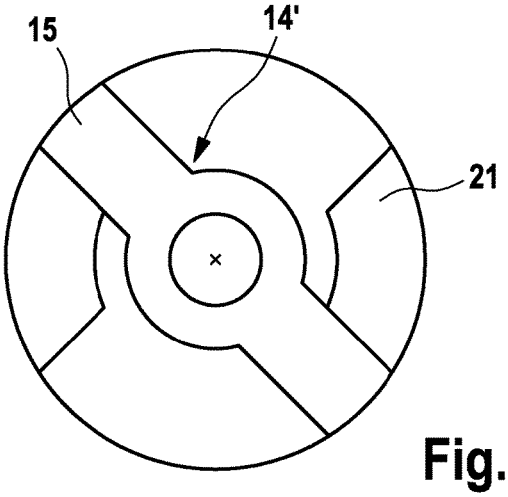
FIG. 3 shows a view of the hammer and anvil as per FIG. 2, but in a rotated position compared with FIG. 2, in which the hammer, driven by a rotary impulse, is striking the anvil.

With the aid of this arrangement, when a relatively large torque is exerted as a particular limit counter-torque on the drive shaft 30 by the screw connection, the hammer 14 carries out an axial movement, counter to the spring force of the coil spring 32, in the direction of the gear mechanism 35 with a superimposed rotary movement relative to the drive shaft 30. The hammer 14 thus rotates along the curved track 59 and trips when a particular rotation angle is exceeded and is moved in the direction of the anvil 18 again under the action of the spring force, such that the drivers 15 of the hammer 14 come into contact with the associated protrusions 21 on the anvil 18 and the hammer 14 transmits its rotary impulse to the anvil 18, as is illustrated in FIG. 3. During the rotary drive by the hammer 14, mechanical and electrical contact occurs between the hammer 14 and anvil 18.

The hammer 14 is connected to the first housing part 27 in an electrically conductive manner via its bearing on the drive shaft 30 and the planetary gear set 35.

In a corresponding manner, the anvil 18 is connected to the second housing part 28 in an electrically conductive manner via the output shaft 60 and the bearing 63.

Since a voltage source 70 is connected between the first housing part 27 and the second housing part 28 via associated contacts 67, 68, contact making between the hammer 14 and anvil 18 can be monitored by means of a sensor 72 arranged between said housing parts.

As long as the hammer 14 is in mechanical contact with the anvil 18 and thus a rotary impulse is transmitted to the anvil 18, this is registered by a corresponding signal from the sensor 72 (cf. FIG. 3*a*) which is transmitted to the central controller 22 via the line 25.

Figure 5:
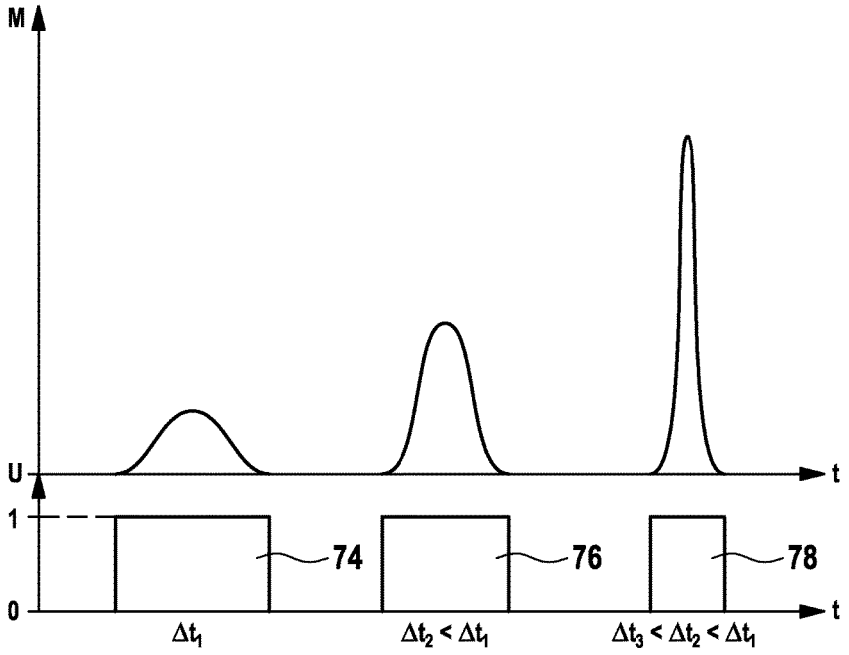
FIG. 5 shows a schematic illustration of the associated torque which arises in case of a sequence of impact impulses.

A sequence of impact impulses thus occurs, as is illustrated schematically in FIG. 5.

The impulse duration decreases from impulse to impulse, i.e. $\Delta t_1$ is greater than the impulse duration $\Delta t_2$ of the following impulse, which is in turn greater than the impulse duration of the next impulse $\Delta t_3$.

Initially, a relatively small torque transmission and a relatively long impulse duration occur. During the following impulses, the impulse duration decreases and the transmitted torque increases, as is indicated in the top half of FIG. 5. The impulse duration is sensed by way of the electrical contact making, as described above.

The central controller is now programmed such that the measured intergral of contact durations $\Delta t_1$, $\Delta t_2$, $\Delta t_3$ . . . between the hammer 14 and anvil 18 is compared with a stored dependence of the torque on the impulse duration and is taken into consideration in a calculation of the tightening torque. Since the rotational speed n is measured by the central controller 22 via an associated sensor (not illustrated) or optionally the output P is known via the controller, the central controller 22 can determine the tightening torque of the screw connection with great accuracy from the measured impulse sequence of the contact durations $\Delta t_1$, $\Delta t_2$, $\Delta t_3$ . . . . Preferably the central controller 22 is configured for switching off the drive when a predetermined tightening torque is reached.

What is claimed is:

1. An impact screwdriver comprising:

a housing;

an impact mechanism received within said housing, wherein said impact mechanism comprises:

an output shaft coupled to a tool receptacle;

an anvil coupled to said output shaft;

a drive shaft for driving said impact mechanism;

a hammer arranged on said drive shaft axially movable electrically insulated from said anvil;

an electric coupling, coupling the hammer to the anvil;

a spring element arranged for preloading said hammer in an axial direction towards said anvil;

a driver for driving said hammer towards said anvil;

a speed sensor arranged for sensing a rotational speed of said drive shaft; and an electrical sensor being arranged for monitoring a voltage signal between said hammer and said anvil during contact between said hammer and said anvil for determining a duration of said contact;

a voltage source being coupled to said hammer and said anvil; and a controller being coupled to said speed sensor and to said electrical sensor for calculating a tightening torque of a screw connection to be tightened based on the rotational speed of said drive shaft and on the contact duration between said hammer and said anvil;

wherein said hammer is driven by said drive shaft via said driver against said anvil and for transmitting a rotary impulse onto said anvil, when a particular angle of rotation is exceeded; and wherein said controller is configured for switching off said impact mechanism upon reaching a predetermined tightening torque.

2. The impact screwdriver of claim 1, wherein said housing comprises a first housing part for receiving said impact mechanism including said drive shaft and said hammer, said first housing part being electrically insulated from a second housing part for receiving said anvil together with said output spindle.

3. The impact screwdriver of claim 2, wherein said first and said second housing parts are each connected to a different pole of said voltage source, and wherein said sensor is arranged for monitoring a current flow between said first and said second housing parts upon contact between said hammer and said anvil.

4. The impact screwdriver of claim 1, wherein said controller is programmed for integrating a sequence of contact durations between said hammer and said anvil and for comparing a result thereof with a stored dependence of tightening torque on impulse duration and for calculating a tightening torque therefrom.

5. The impact screwdriver of claim 1, further comprising a planetary gear being configured for driving said drive shaft.

6. The impact screwdriver of claim 5, wherein said planetary gear comprises a planet gear carrier whereon a plurality of planet gears are mounted rotatably, and wherein said planet gear carrier is coupled to said drive shaft for common rotation therewith.

7. The impact screwdriver of claim 6, wherein said planet gear carrier is mounted on said housing rotatably.

8. The impact screwdriver of claim 6, wherein said planet gears are arranged for meshing with a sun gear being driven by a motor shaft.

9. An impact screwdriver comprising:

a housing;

an impact mechanism received within said housing, wherein said impact mechanism comprises:

an output shaft coupled to a tool receptacle;

an anvil coupled to said output shaft;

a drive shaft for driving said impact mechanism;

a hammer arranged on said drive shaft axially movable electrically insulated from said anvil;

an electric coupling, coupling the hammer to the anvil;

a spring element arranged for preloading said hammer in an axial direction towards said anvil;

a driver for driving said hammer towards said anvil;

a speed sensor arranged for sensing a rotational speed of said drive shaft; and an electrical sensor being arranged for monitoring a voltage between said hammer and said anvil during contact between said hammer and said anvil for determining a duration of said contact;

a voltage source being coupled to said hammer and said anvil; and a controller being coupled to said speed sensor and to said electrical sensor for calculating a tightening torque of a screw connection to be tightened based on the rotational speed of said drive shaft and on the contact duration between said hammer and said anvil;

wherein said hammer is driven by said drive shaft via said driver against said anvil and for transmitting a rotary impulse onto said anvil, when a particular angle of rotation is exceeded.

10. The impact screwdriver of claim 9, wherein said housing comprises a first housing part for receiving said impact mechanism including said drive shaft and said hammer, said first housing part being electrically insulated from a second housing part for receiving said anvil together with said output spindle.

11. The impact screwdriver of claim 10, wherein said first and said second housing parts are each connected to a different pole of said voltage source, and wherein said sensor is arranged for monitoring a current flow between said first and said second housing parts upon contact between said hammer and said anvil.

12. The impact screwdriver of claim 9, wherein said controller is programmed for integrating a sequence of contact durations between said hammer and said anvil and for comparing a result thereof with a stored dependence of tightening torque on impulse duration and for calculating a tightening torque therefrom.

13. The impact screwdriver of claim 9, further comprising a planetary gear being configured for driving said drive shaft.

14. The impact screwdriver of claim 13, wherein said planetary gear comprises a planet gear carrier whereon a plurality of planet gears are mounted rotatably, and wherein said planet gear carrier is coupled to said drive shaft for common rotation therewith.

15. The impact screwdriver of claim 14, wherein said planet gear carrier is mounted on said housing rotatably.

16. The impact screwdriver of claim 14, wherein said planet gears are arranged for meshing with a sun gear being driven by a motor shaft.

17. An impact screwdriver comprising:

a housing;

an impact mechanism received within said housing, wherein said impact mechanism comprises:

an output shaft coupled to a tool receptacle;

an anvil coupled to said output shaft;

a drive shaft for driving said impact mechanism;

a hammer arranged on said drive shaft axially movable;

an electric coupling, coupling the hammer to the anvil;

a spring element arranged for preloading said hammer in an axial direction towards said anvil;

a driver for driving said hammer towards said anvil;

wherein said hammer is driven by said drive shaft via said driver against said anvil and for transmitting a rotary impulse onto said anvil, when a particular angle of rotation is exceeded;

wherein said hammer and said anvil are mounted electrically insulated against one another and are connected to a voltage source; and wherein a sensor is arranged for monitoring a voltage between said hammer and said anvil during contact between said hammer and said anvil for determining a duration of said contact.

18. The impact screwdriver of claim 17, further comprising means for switching off said impact mechanism upon reaching a predetermined tightening torque.

19. The impact screwdriver of claim 17, wherein said housing comprises a first housing part for receiving said impact mechanism including said drive shaft and said hammer, said first housing part being electrically insulated from a second housing part for receiving said anvil together with said output spindle; and wherein said first and said second housing parts are each connected to a different pole of said voltage source, and wherein said sensor is arranged for monitoring a current flow between said two housing parts upon contact between said hammer and said anvil.

20. The impact screwdriver of claim 17, further comprising a controller programmed for integrating a sequence of contact durations between said hammer and said anvil and for comparing a result thereof with a stored dependence of tightening torque on impulse duration and for calculating a tightening torque therefrom.

21. The impact screwdriver of claim 17, further comprising a controller for switching off said impact mechanism upon reaching a predetermined tightening torque.

* * * * *